US005553771A

United States Patent [19]

Correll

[11] Patent Number: 5,553,771

[45] Date of Patent: Sep. 10, 1996

[54] RESOURCE SAVING BOX

[76] Inventor: John D. Correll, 8459 Holly Dr., Canton, Mich. 48187

[21] Appl. No.: 289,306

[22] Filed: Aug. 11, 1994

Related U.S. Application Data

[63] Continuation-in-part of Ser. No. 69,830, Jun. 1, 1993, Pat. No. 5,381,949, Ser. No. 145,248, Nov. 1, 1993, and Ser. No. 272,677, Jul. 8, 1994.

[51] Int. Cl.[6] ..... B65D 5/24; B65D 5/42

[52] U.S. Cl. ..... 229/110; 229/149; 229/150; 229/195; 229/198.2; 229/933; 229/935

[58] Field of Search ..... 229/109, 110, 229/148, 152, 154, 165, 195, 198.2, 933, 935, 936, 149, 150

[56] References Cited

U.S. PATENT DOCUMENTS

| | | | |
|---|---|---|---|
| 279,199 | 6/1883 | Stevens | 229/198.2 |
| 504,824 | 9/1893 | Cook | 229/154 |
| 1,451,963 | 4/1923 | Scruby | 229/108.1 |
| 1,530,644 | 3/1925 | Blandford . | |
| 1,649,088 | 11/1927 | Tinsley | 229/108 |
| 2,429,540 | 10/1947 | Woodruff . | |
| 2,435,283 | 2/1948 | Lighter . | |
| 2,751,138 | 6/1956 | Laver | 229/109 |
| 2,756,919 | 7/1956 | Davidson | 229/936 |
| 2,789,750 | 4/1957 | Kramer . | |
| 2,819,833 | 1/1958 | Sauer . | |
| 2,925,213 | 2/1960 | Zukoski . | |
| 2,925,950 | 2/1960 | Burg | 229/110 |
| 2,934,254 | 4/1960 | Ullger | 229/108.1 |
| 3,003,674 | 10/1961 | Ringler | 229/152 |
| 3,086,691 | 4/1963 | Fobiano | 229/195 |
| 3,105,626 | 10/1963 | McCormick et al. | 229/148 |
| 3,371,842 | 3/1968 | Hechtmann et al. . | |
| 3,497,127 | 2/1970 | Box | 229/198.2 |
| 3,572,576 | 3/1971 | Foster | 229/936 |
| 3,633,815 | 1/1972 | Rosenburg, Jr. | 229/110 |
| 3,744,705 | 7/1973 | Kuhn et al. | 229/148 |
| 4,053,099 | 10/1977 | Lock . | |
| 4,332,577 | 6/1982 | Mosse . | |
| 4,471,902 | 9/1984 | Skaggs | 229/148 |
| 4,494,689 | 1/1985 | Ilitch | 229/165 |
| 4,516,718 | 5/1985 | Forbes, Jr. | 229/148 |
| 4,567,341 | 1/1986 | Brown . | |
| 4,620,666 | 11/1986 | Lacasa et al. | 229/149 |
| 4,655,386 | 4/1987 | Billberg . | |
| 4,804,136 | 2/1989 | Hall . | |
| 5,118,033 | 6/1992 | Kula . | |
| 5,226,587 | 7/1993 | Eisman et al. | 229/148 |
| 5,381,949 | 1/1995 | Correll | 229/198.2 |

FOREIGN PATENT DOCUMENTS

| | | | |
|---|---|---|---|
| 2560152 | 8/1985 | France | 229/198.2 |
| 2312859 | 9/1974 | Germany | 229/148 |

*Primary Examiner*—Gary E. Elkins

[57] ABSTRACT

A type of box comprising three unique components: (1) an over-extending trapezoid-shape diagonal side wall, (2) a flapless corner interlock, and (3) a cover with parallel free side edges and obliquely disposed cover interlock flaps. The preferred embodiments have six side walls consisting of a rear wall, first and second opposing side walls, third and fourth opposing side walls extending obliquely from the first and second side walls, and a front wall opposing the rear wall. Also disclosed is a two-part cover interlock flap that engages with the third and fourth diagonal side walls.

17 Claims, 4 Drawing Sheets

RESOURCE SAVING BOX

CROSS REFERENCES TO RELATED APPLICATIONS

This is a continuation-in-part application of my application 08/069,830, entitled "Box," filed on Jun. 1, 1993 now Pat. No. 5,381,949, my application 08/145,248, entitled "Box for Pizza or The Like," filed on Nov. 1, 1993 pending, and my application 08/272,677 entitled "Mating Box Blanks" filed on Jul. 8, 1994 pending.

FIELD OF THE INVENTION

This invention relates to boxes and blanks made of foldable material and, in particular, to boxes for relatively flat food products such as pizza and the like.

DESCRIPTION OF THE PRIOR ART

In the pizzeria industry, the cost of the box for delivery and carry-out pizza is a substantial part of the total cost of the product and, therefore, a concern of many pizza companies. The main cost component of corrugated pizza boxes is the material consumed in making the blank. To achieve a minimum amount of material consumption during manufacture of blanks, a blank should (a) have a cover with a front edge that terminates in a free edge (i.e., have no front cover flap), (b) have no points on the bottom panel extending beyond the outermost lateral edges of the product, and (c) be capable of inverted mating or nesting during manufacture of multiple blanks.

In addition, many consumers are concerned about wasteful consumption of natural resources. To achieve good relations with environmentally-conscious customers, many pizza companies would benefit from a box that conserves a maximum amount of material and, therefore, natural resources.

Further, a box must meet the performance requirements of pizza companies. Some companies require at least one square corner on a box for accommodating storage of an extra item, such as a small cup of sauce or a packet of spices. In addition, some of those same companies also want to contain the product on more than four sides so as to reduce slice separation during transit. To provide storage along with reduced slice separation, a box with at least one square corner and five or more side walls is needed.

To meet additional performance requirements of many pizza companies, a box should be capable of being folded quickly in order to reduce labor time and payroll expense. To achieve fast folding, a box must have a minimum number of panels and flaps that need pre-folding before the blank can be set up into a box. Along with fast folding, a box should be capable of being opened quickly for inserting a pizza and, most importantly, should be capable of being re-folded quickly after a pizza has been placed into the carton. To achieve fast re-folding, a box must have a minimum number of corner and cover interlocks that need relocking or tucking in before the box can be closed.

For further savings in labor time, a box should allow for in-box pizza cutting. With this method, a pizza is taken from the oven and placed directly into the box and then cut on the bottom panel of the carton. The alternate, more labor intensive method is out-of-box cutting, which requires a pizza to be placed on a cutting board, then cut, and then slid into the box. For optimal in-box cutting, the walls of the box should fall away or slope outwards after the cover interlock is disengaged from the box.

Another performance requirement desired by some pizza companies is elimination of the chance of accidental cover opening. With most types of pizzas, to secure the cover of a loaded box a frictional type of cover-to-wall interlock is sufficient to prevent accidental opening. However, a few companies, who sell a very heavy pizza, have a problem with the corner of a loaded box sagging downward and the cover accidentally opening. To eliminate accidental opening, a positive locking cover-to-wall interlock is beneficial.

Still another performance requirement desired by some pizza companies is reduced chance of juices leaking from the box. To achieve this, the bottom panel should be free of slots.

A final requirement of a pizza box desired by some companies is a reduction of cover side edge curling while the loaded box is kept under a heat lamp. While waiting for a delivery driver or customer to pick up a pizza, some companies temporarily place a loaded box under a heat lamp to retain product heat. During this time, the inner liner of the cover absorbs steam from the pizza while the outer liner dries out from being exposed to the heat lamp. The result is that the cover tends to curl upward on the sides, producing an undesirable gap between the cover and side walls. To prevent cover side edge curling, a box must either have a full-length front cover flap (which requires extra box material and, therefore, extra cost) or the cover must be interlocked to the box near the corners.

In recent years several pizza box designs with five or more side walls have been been invented. Examples include Zion et al. U.S. Pat. No. 4,765,534 granted on Aug. 23, 1988, Philips U.S. Pat. No. 5,110,039 granted on May 5, 1992, Geho U.S. Pat. No. 5,118,032 granted on Jun. 2, 1992, Patton U.S. Pat. No. 5,211,329 granted on May 18, 1993, and Korine U.S. Pat. No. 5,263,634 granted on Nov. 23, 1993. However, none of them have adequately solved all the above-described problems.

Specifically, all five of the above-cited designs are awkward and slow to fold from a blank to a box, are slow to re-fold after placing product inside the box, are susceptible to cover side edge curling, consume a large amount of material per blank and, therefore, are costly to produce. All except Geho have cover side flaps that preclude manufacturing multiple blanks in inverted mating configuration for additional material savings. However, Geho has a bottom panel with points extending beyond the outermost lateral edges of the product (due to its hexagonal shape) which consumes excess material and, therefore, raises manufacturing cost. Further, three of them, namely Zion et al., Geho, and Korine, have no square corners for storing extra items. Also, because of its fixed corners, Patton is non-conducive to in-box pizza cutting, and because of its long slots along the bottom panel it can leak juice. So, there has remained a challenge for pizza companies of how to reduce packaging cost while improving packaging performance. As noted, no prior art design has solved all the above-described problems; however, my invention does.

In addition, three pizza boxes with five or more side walls have been in use for several years. First, there is a box in Canada that resembles the above-described Patton box almost exactly and, therefore, has the same disadvantages. Also in Canada there is an eight-sided box. Finally, there is a five-sided box, shaped like a baseball home plate, that has been used for special events. All of these boxes suffer from the same above-described problems as the other boxes do.

So, there has remained a challenge for pizza companies of how to reduce packaging cost while improving packaging performance. As noted, there are a number of problems that have not been solved by the prior art. However, they are solved by my invention. By solving these problems, a pizza company can reduce costs, conserve resources, save labor time, and deliver their product in a superior package.

My invention can comprise one or more of three unique components, each component resulting in special advantages. The three components are (1) an over-extending trapezoid-shape diagonal side wall, (2) a flapless corner interlock, and (3) a cover with parallel free side edges and obliquely disposed cover interlock flaps. In addition, my invention offers a choice of cover-to-diagonal-wall interlock means, with specific versions solving specific problems. For example, one version reduces box re-folding time to a minimum, while a second version eliminates the chance of accidental cover opening by providing a positive interlock using a two-part cover flap interlocking with a diagonal side wall.

Prior art examples of a trapezoid-shape diagonal side wall include Carson U.S. Pat. No. 1,959,613 granted on May 26, 1934, Reich U.S. Pat. No. 2,071,949 granted on Feb. 23, 1937, Metcalf U.S. Pat. No. 2,336,494 granted on Dec. 14, 1943, Lin U.S. Pat. No. 3,964,668 granted on Jun. 22, 1976, Austin et al. U.S. Pat. No. 4,279,933 granted on Jul. 21, 1981, and Webinger U.S. Pat. No. 4,362,266 granted on Dec. 7, 1982. While all of them show a trapezoid-shape wall, none of them show the end of the trapezoid wall extending beyond the end of an adjacent wall. Further, none of them connect the trapezoid wall to the adjacent wall with a single panel, as done in my invention.

Prior art examples of a corner interlock using a coplanar tab on one wall extending through a slot in an adjacent wall include Ikeda et al, U.S. Pat. No. 2,072,753 granted on Mar. 2, 1937, Shoemaker U.S. Pat. No. 2,147,676 granted on Feb. 21, 1939, and Swiss patent 591,369 granted Sep. 15, 1977. While all of them show a tab-in-slot arrangement, none of them employ the cover interlock to retain the end wall in an upright position and, thereby, retain the tab in the slot, as done in my invention. Further, none of them show the side end of the end wall (with the slot) terminating in a free edge.

Regarding a cover with free side edges and obliquely disposed cover interlock flaps, Borchers U.S. Pat. No. 1,482,727 granted on Feb. 5, 1924, shows a six-sided box with cloth hinges and a cover without cover interlock means.

Regarding a positive-locking two-part cover interlock, Orchard U.S. Pat. No. 4,265,393 granted on May 5, 1981, shows cover interlocks positioned on parallel side edges of the cover. In this position the interlock flaps protrude far beyond the lateral edges of the cover and, as a result, are easily damaged during transit and handling of the blanks. This has remained an unsolved problem for box manufacturers and pizzerias. However, my invention solves the problem by positioning the two-part cover interlocks on the diagonal edges of the cover, thereby preventing them from protruding far beyond the lateral edges of the cover.

In conclusion, it would be highly desirable to provide a resource saving box that overcomes the above-described problems and disadvantages.

OBJECT AND ADVANTAGES

Accordingly, the object of my invention is a type of pizza box that does one or more of the following: (1) can be manufactured using a minimum amount of material per blank (i.e., has no front cover flap, has no points on the bottom panel extending beyond the outermost lateral edges of the product, and can be produced in multiple blanks in inverted mating configuration), (2) contacts the product on five or more sides yet has at least one square corner for storing extra items, (3) is fast to fold and re-fold, (4) has a secure cover-to-diagonal-wall interlock; (5) has a complete seal around the bottom edge perimeter, (6) resists cover side edge curling, and (7) allows for easy in-box pizza cutting.

The advantages of my invention are as follows:

1. Reduced packaging cost for pizza companies.
2. Opportunity to build public goodwill by advertising a maximum resource saving pizza box.
3. Better looking product resulting from reduced slice separation, which results from containing the product on six sides.
4. Convenience in packaging extra items resulting from having a square corner in the box.
5. More efficient handling of rush hour business resulting from fast re-folding of the box and being able to utilize in-box pizza cutting.
6. Better box appearance and product heat retention due to reduced cover side edge curling.
7. Elimination of accidental cover opening due to secure cover-to-diagonal-wall interlock, with the option of a special two-part flap for positive engagement.
8. Reduced customer and employee complaints about juice leaking from the box, resulting from a complete seal around the bottom edge perimeter.
9. Reduced labor time and payroll cost due to reduced time required to fold the box.

Further objects and advantages of the invention will become apparent from consideration of the following detailed description, related drawings, and appended claims, all of which form a part of this specification.

SUMMARY OF THE INVENTION

In accordance with the invention, a box is created that can incorporate one or more of three unique components, plus a choice of cover-to-diagonal-wall interlock means, each component solving a number of problems and providing a number of advantages.

The first component is an over-extending wall and wall-end panel configuration that speeds folding and refolding of the box, allows for in-box pizza cutting, eliminates slots along the bottom edge perimeter to prevent juice leaking, and can allow an opportunity for an extra-wide diagonal cover flap that provides a secure cover interlock and minimizes the chance of cover side edge curling.

The second component is a flapless corner interlock on the rear corners, which speeds folding and re-folding of the box and, also, enables multiple blanks to be manufactured in inverted mating configuration.

The third component is a cover with free side edges and obliquely disposed cover interlock flaps, which reduces folding and re-folding time and, most importantly, allows multiple blanks to be manufactured in inverted mating configuration for considerable material and cost savings.

Finally, an optional positive interlock means provides a two-part cover flap that interlockingly engages with diagonal side walls of the box.

The box is typically used for packaging relatively flat food products such as pizza and the like; however, it can serve other purposes, as well. A complete understanding of the invention can be obtained from the detailed description that follows.

LIST OF REFERENCE NUMERALS

Figure 2:
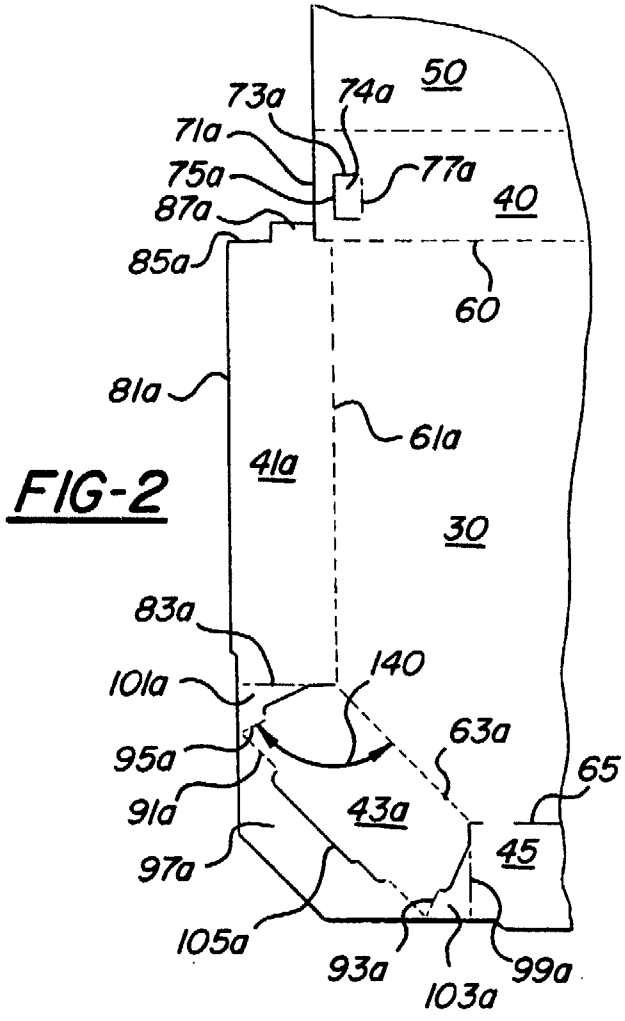
FIG. 2 is an enlarged section of the left side of the blank of FIG. 1.

Within a drawing, closely related figures have the same number but different alphabetic suffixes. Between drawings, like reference numerals designate corresponding parts.

11 blank of first preferred embodiment
**11*a*** first blank
**11*b*** second blank
12 box of first preferred embodiment
13 blank of second preferred embodiment
**13*a*** first blank
**13*b*** second blank
14 box of second preferred embodiment
30 bottom panel
40 rear wall
**41*a*** first side wall
**41*b*** second side wall
**43*a*** third side wall
**43*b*** fourth side wall
45 front wall
50 cover
**51*a*** first side cover edge
**51*b*** second side cover edge
**53*a*** third side cover edge
**53*b*** fourth side cover edge
55 front cover edge (rear end edge of blank)
60 rear wall fold line (wall bottom edge)
**61*a*** first side wall fold line (wall bottom edge)
**61*b*** second side wall fold line (wall bottom edge)
**63*a*** third side wall fold line (wall bottom edge)
**63*b*** fourth side wall fold line (wall bottom edge)
65 front wall fold line (wall bottom edge)
70 cover fold line (rear cover edge; top edge of rear wall)
**71*a*** first end
**71*b*** second end
**73*a*** first opening
**73*b*** second opening
**74*a*** first opening flap
**74*b*** second opening flap
**75*a*** first portion of outer periphery
**75*b*** first portion of outer periphery
**77*a*** opening flap fold line
**77*b*** opening flap fold line
**81*a*** top edge
**81*b*** top edge
**83*a*** front end
**83*b*** front end
**85*a*** rear end
**85*b*** rear end
**87*a*** first rear corner tab
**87*b*** second rear corner tab
**91*a*** top edge
**91*b*** top edge
**93*a*** front end
**93*b*** front end
**95*a*** rear end
**95*b*** rear end
**97*a*** first ancillary wall panel
**97*b*** second ancillary wall panel
98 top edge of front wall (front end edge of blank)
**99*a*** first end
**99*b*** second end
**101*a*** first wall-end panel
**101*b*** second wall-end panel
**103*a*** third wall-end panel
**103*b*** fourth wall-end panel
**105*a*** first slot-forming slit (slot in box)
**105*b*** second slot-forming slit (slot in box)
**106*a*** first slot-forming slit (slot in box)
**106*b*** second slot-forming slit (slot in box)
**110*a*** first cover interlock flap
**110*b*** second cover interlock flap
**111*a*** first part of first two-part cover interlock flap
**111*b*** first part of second two-part cover interlock flap
**112*a*** second part of first two-part cover interlock flap
**112*b*** second part of second two-part cover interlock flap
**118*a*** first two-part cover interlock flap
**118*b*** second two-part cover interlock flap
121 width of bottom panel,
122 width of cover (length of rear wall)
123 length of first (and second) side wall
124 length of third (and fourth) side wall
125 length of front wall
126 length of bottom edge of third (and fourth) side wall
127 length of blank
128 imaginary midline
131 plane of rear wall

132 plane of first side wall

133 plane of third side wall

134 plane of front wall

140 obtuse angle

DESCRIPTION OF THE PREFERRED EMBODIMENTS

There are two preferred embodiments and they both involve a box with six side walls consisting of a rear wall, first and second opposing side walls extending perpendicularly from the rear wall, third and fourth opposing side walls extending obliquely from the first and second side walls, and a front wall opposing the rear wall.

It will be appreciated, as the description proceeds, that my invention comprises three unique components. The three components are (1) over-extending trapezoid-shape diagonal side wall, (2) flapless corner interlock, and (3) cover with parallel free side edges and obliquely disposed cover interlock flaps. It will also be appreciated that my invention may be realized in different embodiments and may be used in other applications.

Figure 4:
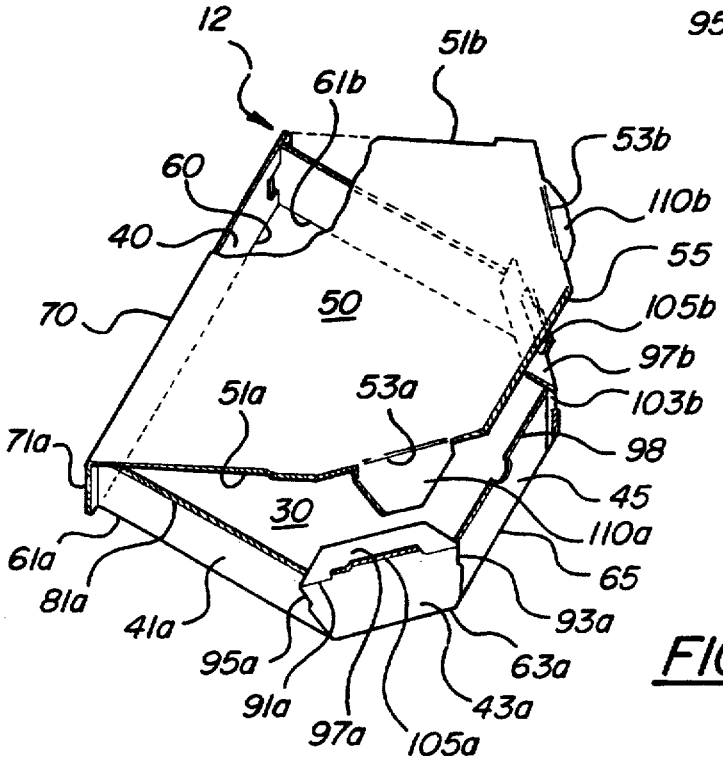
FIG. 4 is a perspective view of the box formed from the blank of FIG. 1.

There is illustrated a first preferred embodiment of the invention in a one-piece blank 11 made of corrugated paperboard (FIG. 1) and, correspondingly, a box 12 created from the blank (FIG. 4 ). A second preferred embodiment is illustrated in a one-piece blank 13 made of corrugated paperboard (FIG. 8) and a box 14 created from the blank (FIG. 9). The following discussion describes blanks 11 and 13, however, because those blanks become boxes 12 and 14, respectively, by extrapolation the discussion also applies to the boxes.

DESCRIPTION OF THE BLANKS

To begin, blanks 11 and 13 have a bottom panel 30. Panel 30 has a predetermined width extending between edges 61*a* and 61*b* shown by dimension line 121 in FIG. 3.

A rear wall 40 is hingedly attached to bottom panel 30 at a rear wall fold line 60. Wall 40 has a top edge 70 and first and second ends 71*a* and 71*b*, respectively. The bottom edge of wall 40 is indicated in the drawing by numeral 60, the same numeral used for indicating the rear wall fold line. It is noted that ends 71*a* and 71*b* terminate in a free edge (or have no flaps attached). Wall 40 has a predetermined length shown by dimension line 122 in FIG. 3 (which is the same as the width of cover 50).

Contained within wall 40 and located near ends 71*a* and 71*b* are first and second openings 73*a* and 73*b*, respectively. It is noted that openings 73*a* and 73*b* are completely contained within wall 40 (or do not border an end of the wall). Openings 73*a* and 73*b* have a first portion of outer periphery 75*a* and 75*b*, respectively, that is approximately aligned with fold lines 61*a* and 61*b*, respectively. Openings 73*a* and 73*b* comprise first and second opening flaps 74*a* and 74*b*, respectively, that are hingedly attached to an edge of the openings at opening flap fold lines 77*a* and 77*b*, respectively.

First and second side walls 41*a* and 41*b*, respectively, are hingedly attached to bottom panel 30 at first and second side wall fold lines 61*a* and 61*b*, respectively. Walls 41*a* and 41*b* have top edges 81*a* and 81*b*, respectively, front ends 83*a* and 83*b*, respectively, and rear ends 85*a* and 85*b*, respectively. The bottom edges of walls 41*a* and 41*b* are indicated in the drawing by numerals 61*a* and 61*b*, respectively, the same numerals used for indicating the first and second side wall fold lines. It is noted that walls 41*a* and 41*b* are disposed perpendicularly to wall 40. It is further noted that wall 41*a* has a predetermined maximum length indicated by dimension line 123 in FIG. 3, which extends between outermost points on front and rear ends 83*a* and 85*a*, respectively. Although not shown in the drawing, a similar maximum length extends between outermost points on wall 41*b*. For clarity, FIG. 2 shows an enlarged section of the left side of blank 11.

Extending from rear ends 85*a* and 85*b* are first and second rear corner tabs 87*a* and 87*b*, respectively. It is noted that tabs 87*a* and 87*b* are unitary with walls 41*a* and 41*b*, respectively. Further, it is noted that blanks 11 and 12 have a predetermined length extending between the furthermost extremities, or front and rear end edges of the blank, indicated by dimension line 127 in FIG. 3, and that there is an imaginary midline 128 that extends across the blank and bisects line 127, and that tabs 87*a* and 87*b* are on the front side of midline 128.

Figure 3:
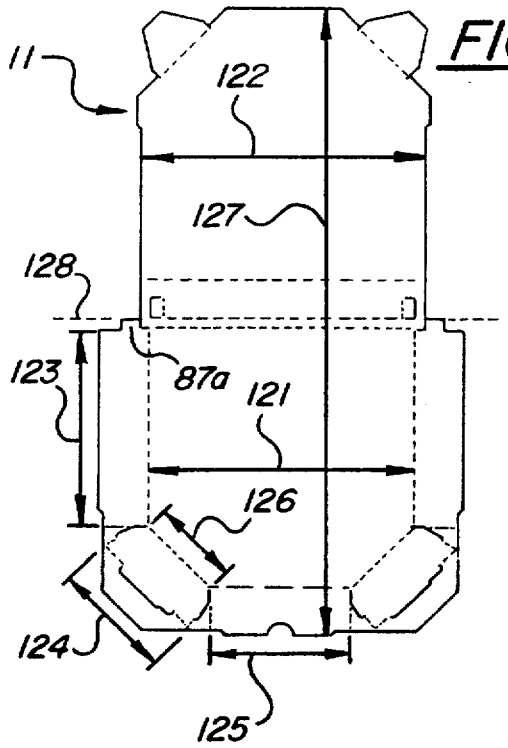
FIG. 3 is a plan view of the blank of FIG. 1 with dimension lines.

Third and fourth side walls 43*a* and 43*b* are hingedly attached to bottom panel 30 at third and fourth side wall fold lines 63*a* and 63*b*, respectively. Walls 43*a* and 43*b* have top edges 91*a* and 91*b*, respectively, front ends 93*a* and 93*b*, respectively, and rear ends 95*a* and 95*b*, respectively. The bottom edges of walls 43*a* and 43*b* are indicated in the drawing by numerals 63*a* and 63*b*, the same numerals used for indicating the third and fourth side wall fold lines. For clarity, the left-side components of blank 11 are depicted in FIG. 2. It is noted that walls 43*a* and 43*b* are disposed at an oblique angle to walls 41*a* and 41*b*, respectively. It is further noted that walls 43*a* and 43*b* are substantially trapezoid-shape, and, as shown in FIG. 3, wall 43*a* has a predetermined maximum length indicated by dimension line 124, which extends between outermost points on front and rear ends 93*a* and 95*a*, respectively. Although not shown in the drawing, a similar maximum length extends between outermost points on wall 43*b*.

A front wall 45 opposing rear wall 40 is hingedly attached to bottom panel 30 at a front wall fold line 65. Wall 45 has a top edge 98 and first and second ends 99*a* and 99*b*, respectively. Wall 40 also has a predetermined length indicated by dimension line 125, as shown in FIG. 3. The bottom edge of wall 45 is indicated in the drawing by numeral 65, the same numeral used for indicating the front wall fold line.

First and second wall-end panels 101*a* and 101*b*, respectively, are hingedly attached to front ends 83*a* and 83*b*, respectively, of walls 41*a* and 41*b*, respectively, and to rear ends 95*a* and 95*b*, respectively, of walls 43*a* and 43*b*, respectively. Third and fourth wall-end panels 103*a* and 103*b*, respectively, are hingedly attached to front ends 93*a* and 93*b*, respectively, of walls 43*a* and 43*b*, respectively, and to first and second ends 99*a* and 99*b*, respectively, of front wall 45. For clarity, the left-side components of blank 11 are depicted in FIG. 2.

A cover 50 is hingedly attached to top edge 70 of rear wall 40. It is noted that line 70 in the drawing also indicates the position of a cover fold line that attaches cover 50 to wall 40. Cover 50 has a rear cover edge (also indicated by numeral 70), opposing first and second side cover edges 51*a* and 51*b*, respectively, third and fourth side cover edges 53*a* and 53*b*, respectively, and a front cover edge 55. It is noted that edges 51*a* and 51*b* are disposed perpendicular to rear cover edge (or cover fold line) 70 and that edges 53*a* and 53*b* are disposed at an oblique angle to edges 51*a* and 51*b*, respectively. Edge 55 is parallel to cover fold line 70. Cover 50 has a predetermined width indicated by dimension line 122, as shown in FIG. 3, which extends between edges 51*a* and 51*b*. (Line 122 also indicates the length of rear wall 40.)

On the first embodiment (FIGS. 1 and 4), first and second ancillary wall panels 97*a* and 97*b*, respectively, are hingedly attached to top edges 91*a* and 91*b*, respectively, of third and fourth side walls 43*a* and 43*b*, respectively. First and second cover interlock flaps 110*a* and 110*b*, respectively, are hingedly attached to edges 53*a* and 53*b*, respectively. To engage flaps 110*a* and 110*b* with walls 43*a* and 43*b*, respectively, slot-forming slits 105*a* and 105*b* are disposed between wall 43*a* and ancillary wall panel 97*a* and between wall 43*b* and ancillary wall panel 97*b*, respectively.

On the second embodiment (FIGS. 8 and 9), ancillary wall panels 97*a* and 97*b* are omitted and first and second two-part cover interlock flaps 118*a* and 118*b*, respectively, have been added in place of cover interlock flaps 110*a* and 110*b*, respectively. Two-part interlock flaps 118*a* and 118*b* are comprised of first parts 111*a* and 111*b*, respectively, that are hingedly attached to edges 53*a* and 53*b*, respectively, and second parts 112*a* and 112*b*, respectively, that are hingedly attached to the end of first flaps 111*a* and 111*b*, respectively. To engage parts 112*a* and 112*b* with walls 43*a* and 43*b*, respectively, slot-forming slits 106*a* and 106*b* are disposed along bottom edges 63*a* and 63*b*, respectively.

DESCRIPTION OF THE BOXES

Figure 1:
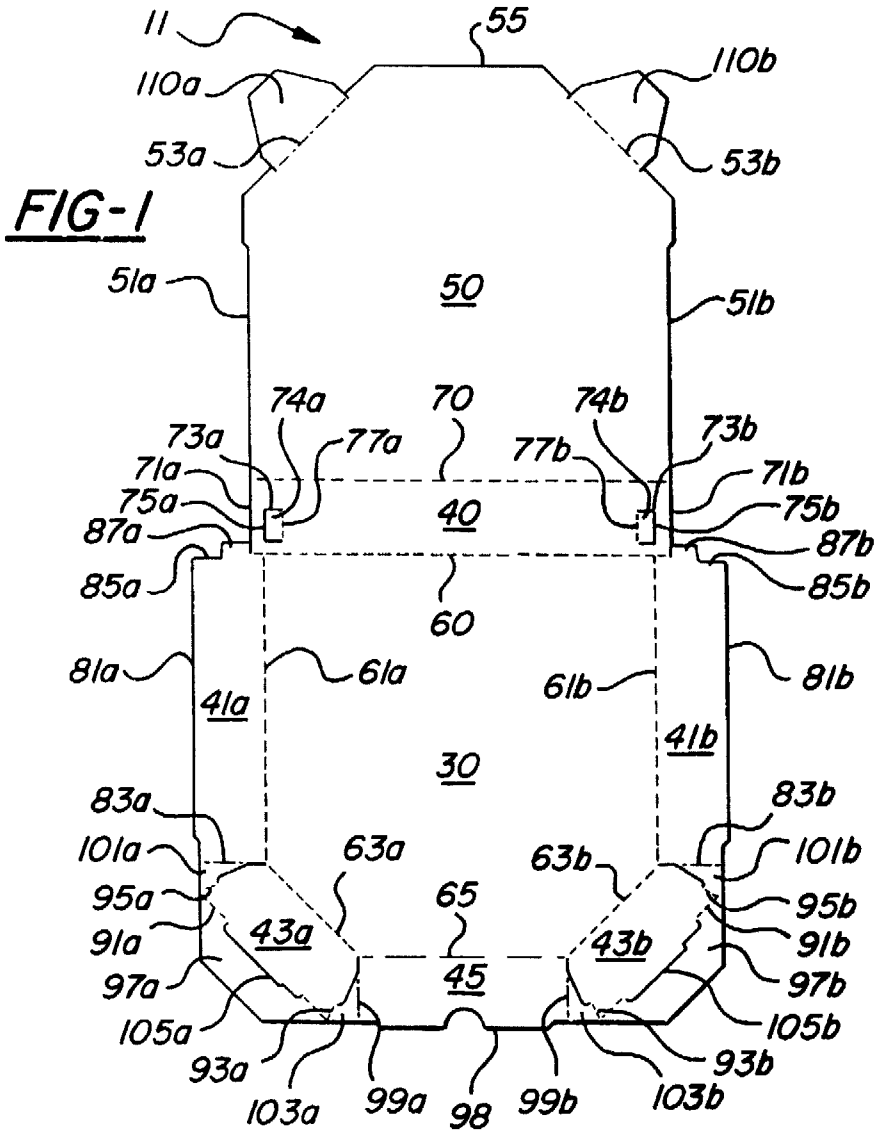
FIG. 1 is a plan view of a blank for making the box of the first preferred embodiment.
Figure 8:
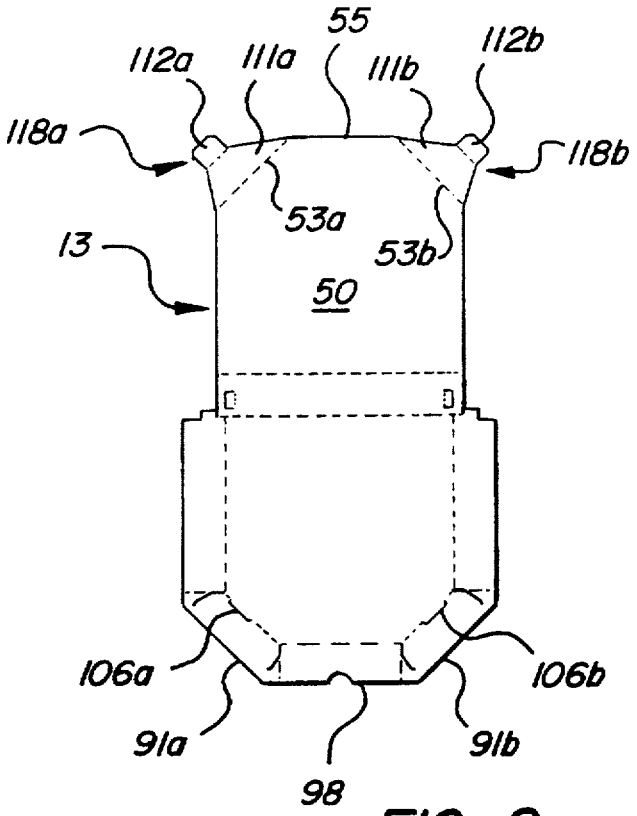
FIG. 8 is a plan view of a blank for making the box of the second preferred embodiment.
Figure 9:
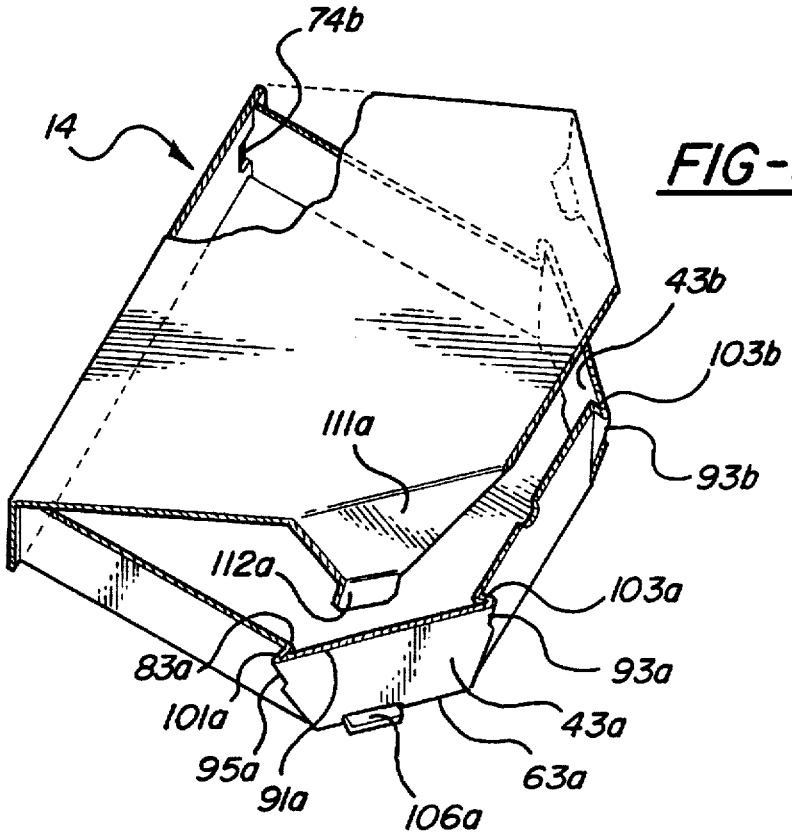
FIG. 9 is a perspective view of the box formed from the blank of FIG. 8.

Blank 11 of FIG. 1 sets up into box 12 of FIG. 4 and blank 13 of FIG. 8 sets up into box 14 of FIG. 9. To describe the boxes, several features must be explained. First, it is noted that boxes 12 and 14 are made of resilient foldable material, specifically corrugated paperboard, so that once a wall is folded there is a resiliency or spring-back force within the wall pushing toward the direction of the wall's unfolded position.

Figure 5:
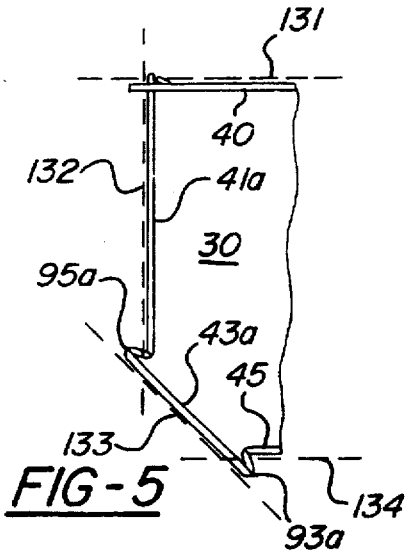
FIG. 5 is a top view of a section of wall assembly showing wall planes.

Second, referring to FIG. 5, it is noted that each part of the box, and in particular each wall, has a plane and, for explanatory purposes, it can be considered that there are two sides to each plane: an interior side and an exterior side. The interior side of each wall plane is the side on which is disposed the cavity of the box; the exterior side is the other side, or the side opposite the cavity of the box. To illustrate, FIG. 5 shows the plane of wall 40 with dashed line 131, the plane of wall 41*a* with line 132, the plane of wall 43*a* with line 133, and the plane of wall 45 with line 134. For clarity, the drawing shows each plane line on the exterior side of the wall, however, in reality, each plane line extends through the middle of the wall. As explained, the interior side of each wall plane is the side disposed adjacent to the cavity of the box or, in the drawing, the side adjacent to bottom panel 30. Further, it is noted that each wall has an inner surface and an outer surface; the inner surface being on the interior, or box cavity, side of the plane and the outer surface being on the exterior side of the plane.

Third, boxes 12 and 14 comprise three unique components: (1) over-extending trapezoid-shape diagonal side wall, (2) flapless corner interlock, and (3) cover with parallel free side edges and obliquely disposed cover interlock flaps. Plus an optional two part cover-to-diagonal-wall interlock flap is shown in FIGS. 8 and 9. Each is described in detail.

Figure 6:
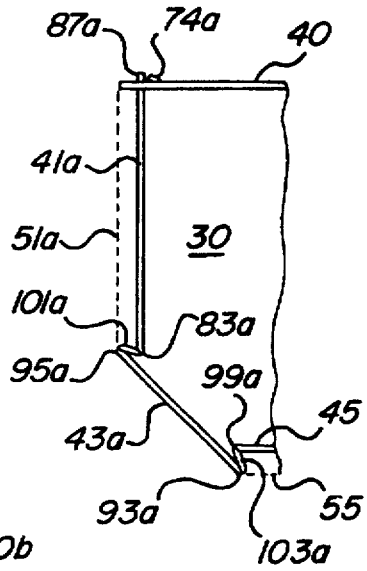
FIG. 6 is a top view of a section of wall assembly showing wall components.

Third and fourth side walls 43*a* and 43*b* are over-extending trapezoid-shape diagonal side walls. They play a special function in the performance of boxes 12 and 14. For simplicity, this discussion describes wall 43*a* only, but it applies similarly to wall 43*b*. Wall 43*a* has a maximum length, indicated by dimension line 124 shown in FIG. 3, that is greater than the length of bottom edge 63*a*, indicated by dimension line 126. As a result, rear end 95*a* extends at an obtuse angle to bottom edge 63*a*. This obtuse angle is indicated by numeral 140 in FIG. 2. Further, front end 83*a* of adjacent wall 41*a* is perpendicular to bottom edge 61*a*. Because of this, rear end 95*a* of wall 43*a* extends outside of and beyond front end 83*a* of wall 41*a*, as shown in FIGS. 6 and 9. So, end 95*a* is on the exterior side of the plane of wall 41*a* or, in other words, end 95*a* is exterior to the plane of wall 41*a*. Similarly, end 93*a* is exterior to the plane of wall 45. This is also shown in FIGS. 6 and 9. Because of the resiliency or spring-back force in the corrugated paperboard, walls 41*a* and 45 have a tendency to push outward or against the inner surface of wall 43*a* and, in so doing, walls 41*a* and 45 are retained in an upright position as long as wall 43*a* is in an upright position.

Shown in FIGS. 6 and 9, to further enhance the operation of trapezoid-shape walls 43*a* and 43*b*, wall-end panels 101*a* and 103*a* are hingedly attached to ends 95*a* and 93*a*, respectively, of wall 43*a* and to ends 83*a* and 99*a*, respectively, of walls 41*a* and 45, respectively, thereby linking wall 43*a* to walls 41*a* and 45. Similarly, wall-end panels 101*b* and 103*b* are hingedly attached to ends 95*b* and 93*b*, respectively, of wall 43*b* and to ends 83*b* and 99*b*, respectively, of walls 41*b* and 45, respectively. As a result, when one of walls 41*a*, 41*b*, 43*a*, 43*b*, and 45 moves, the other four walls move as well. In effect, all five walls move as one unit. This feature facilitates fast folding and re-folding of boxes 12 and 14. In addition, as long as walls 43*a* and 43*b* are interlocked with cover 50, all five of the walls are locked in an upright position.

Figure 7:
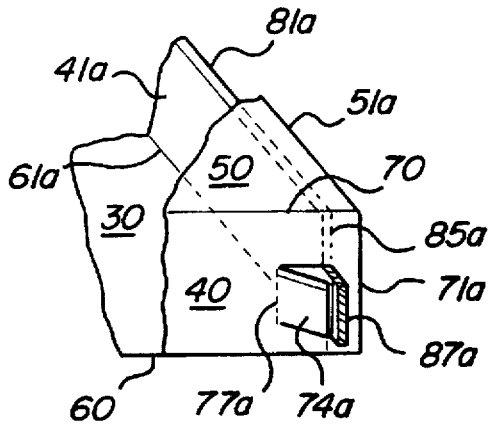
FIG. 7 is a rear perspective view of a rear corner of the box.

The second unique component of boxes 12 and 14 is flapless corner interlocks on the rear corners, or between rear wall 40 and side walls 41*a* and 41*b*. This is depicted in FIG. 7, which shows a rear perspective view of a rear corner of the box. Rear corner tabs 87*a* and 87*b* extending through openings 73*a* and 73*b* constitute the essence of the interlock. Because of the resiliency or spring-back force in corrugated paperboard, tabs 87*a* and 87*b* are pushed against portions of outer periphery 75*a* and 75*b*, respectively, which are aligned with fold lines 61*a* and 61*b*, respectively. (In FIG. 7, periphery 75*a* is behind tab 87*a* and, therefore, cannot be seen, but it is indicated in FIGS. 1 and 2.) As a result, the rear ends of walls 41*a* and 41*b* are held in an upright position as long as rear wall 40 is in an upright position. This feature facilitates fast folding and re-folding of boxes 12 and 14 because, unlike most boxes, there is no flap on the end of the rear wall or side wall that requires folding in order to set up the box.

An optional feature of the corner interlock is opening flaps 74*a* and 74*b*. When the box is set up, flaps 74*a* and 74*b* are pushed open and held in an open position by tabs 87*a* and 87*b*, respectively. In the open position, flaps 74*a* and 74*b* are disposed at an angle to rear wall 40. Flaps 74*a* and 74*b* play no functional role in boxes 12 and 14 but, instead, merely eliminate the nuisance of having to knock out small pieces of board during manufacture of the blank to create openings 73*a* and 73*b*.

The third unique component of boxes 12 and 14 is an extra wide cover with parallel free side edges and obliquely disposed cover interlock flaps. As shown in FIG. 3, cover 50 has a predetermined width 122 and bottom panel 30 has a predetermined width 121, and width 122 is greater than width 121, thereby making cover 50 overlap top edges 81*a* and 81*b* of walls 41*a* and 41*b*, respectively. (The positions of cover edges 51*a* and 55 in relation to walls 41*a* and 45 are shown by dashed lines in FIG. 6.) As a result, cover 50 is supported on the sides without the need of cover side flaps (as is used in most other pizza boxes). This facilitates fast folding and re-folding of boxes 12 and 14.

Figure 10:
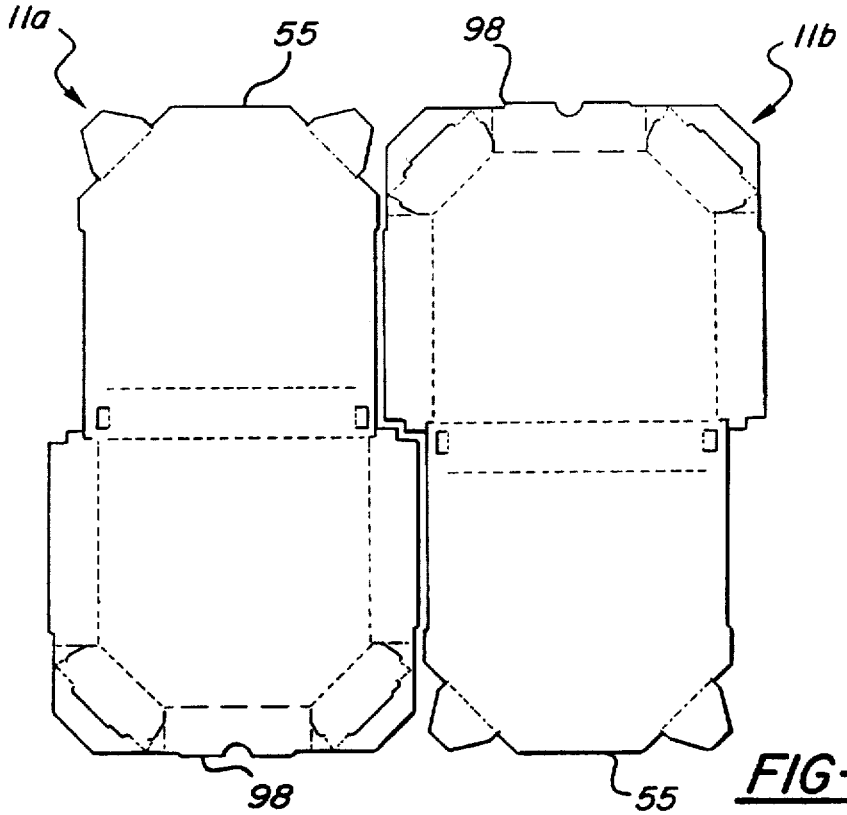
FIG. 10 is a plan view of two blanks of FIG. 1 shown side-by-side in cutting die arrangement.
Figure 11:
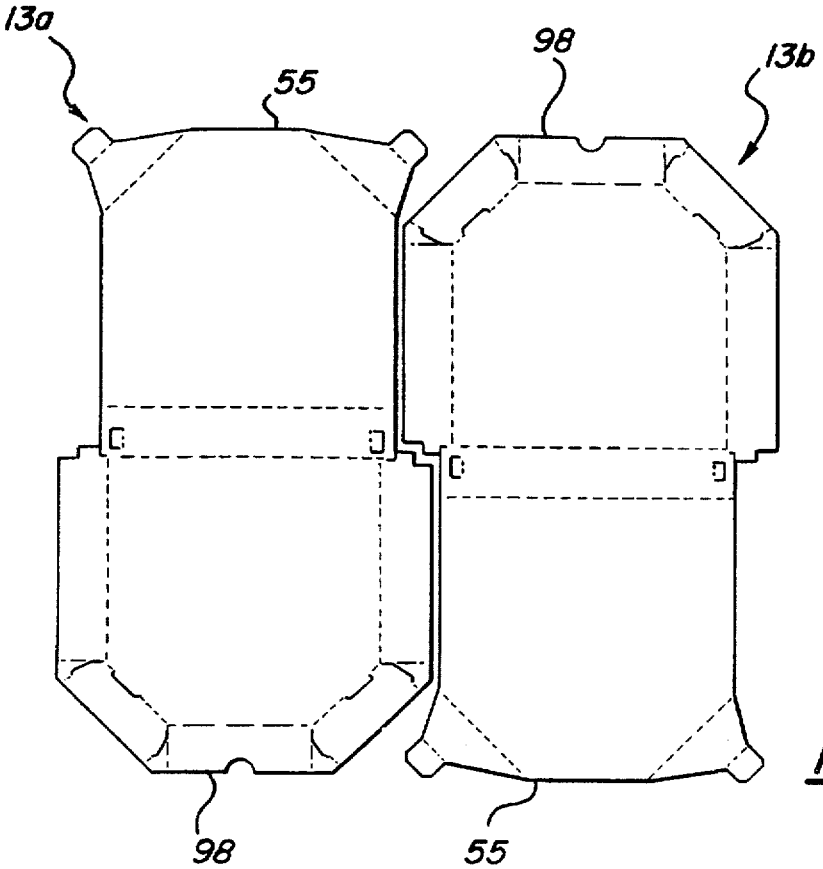
FIG. 11 is a plan view of two blanks of FIG. 8 shown side-by-side in cutting die arrangement.

As noted, cover side edges 51*a* and 51*b* are free edges (no cover flaps attached). In combination with a cover-to-third-and-fourth-wall interlock means, this allows multiple copies of blanks 11 and 13 to be manufactured in inverted mating configuration, or disposed side-by-side and oriented one hundred eighty degrees one to another, as shown in FIGS. 10 and 11.

Cover Interlocks

To achieve inverted mating, a cover-to-third-and-fourth-wall interlock means is used. To engage the interlock with walls 43*a* and 43*b*, several variations of the means are possible. One preferred variation, as previously explained and shown in FIGS. 1 and 4, involves first and second cover interlock flaps 110*a* and 110*b*, respectively. When blank 11 is set up into box 12, cover interlock flaps 110*a* and 110*b* are received by cover interlock slots created from slot-forming slits 105*a* and 105*b*, respectively, whereby cover 50 is interlockingly engaged with third and fourth side walls 43*a* and 43*b*, respectively. This type of interlock provides a frictional type of engagement.

A second variation of cover-to-third-and-fourth-wall interlock means, as previously explained and shown in FIGS. 8 and 9, provides a positive type of engagement. Blank 13 is similar to blank 11 except that ancillary wall panels 97*a* and 97*b* are omitted and first and second two-part cover interlock flaps 118*a* and 118*b*, respectively, have been added in place of cover interlock flaps 110*a* and 110*b*, respectively. When the blank is set up into a box, parts 111*a* and 111*b* are disposed in front of and parallel to walls 43*a* and 43*b*, respectively, and parts 112*a* and 112*b* are disposed perpendicular to walls 43*a* and 43*b*, respectively, and received in slots 106*a* and 106*b*, along the bottom edge of walls 43*a* and 43*b*, respectively, whereby cover 50 is interlockingly engaged with third and fourth walls 43*a* and 43*b*. This type of interlock provides a positive engagement, whereby the cover will not open until parts 112*a* and 112*b* are removed from slots 106*a* and 106*b*.

Manufacture of Mating Blanks

As previously noted, for additional material and cost savings, blanks 11 and 13 can be manufactured in inverted mating configuration, or with two or more blanks disposed side-by-side and oriented at one hundred eighty degrees from each other and nested together. For brevity of definition, a blank having a structure that allows the blank to be manufactured in inverted mating configuration with the end edges approximately aligned is called a "matable, alignable blank." For maximum savings, the end edges of adjacent blanks must align. FIG. 10 shows first and second blanks 11*a* and 11*b*, respectively, (which are copies of blank 11) in inverted mating configuration. Similarly, FIG. 11 shows first and second blanks 13*a* and 13*b*, respectively (which are copies of blank 13). It is noted that in the inverted mating configuration, the rear end of the second side wall of the first blank is disposed adjacent to the rear end of the corresponding side wall of the second blank. In FIGS. 10 and 11, the second side wall and the rear end happens to be 41*b* and 85*b*, respectively (not marked in FIGS. 10 and 11 but shown in FIG. 1). Finally, it is noted that the position of the blanks can be reversed, whereupon the corresponding side walls would be 41*a* and the adjacent rear ends would be 85*a*.

Blanks 11 and 13 have front and rear end edges 98 and 55, respectively (the same numerals as used for indicating the top edge of wall 45 and the front edge of cover 50, respectively.) Edges 98 and 55 are the furthermost extremities of the blank. During manufacture of blanks, edge 98 of one blank is aligned with edge 55 of an adjacent blank, thereby reducing material usage to a minimum.

For illustrative purposes, a small gap is shown between the blanks in FIGS. 10 and 11. It is possible to manufacture the blanks with a gap between them and still be within the scope of the invention. However, it will be appreciated that in the blank-cutting process the blanks will likely be contiguous and, therefore, such gap will probably not exist.

It is noted that, to achieve inverted mating, blanks 11 and 13 embody two features. First, cover sides edges 51*a* and 51*b* are free edges (with no cover side flaps attached). Second, rear ends 85*a* and 85*b* of side walls 41*a* and 41*b*, respectively, are free of corner flaps that would prohibit inverted mating. As shown in FIG. 3, blank 11 (and also blank 13) have a predetermined length 127 extending between front and rear end edges (which are edges 98 and 55, respectively, although not numbered in FIG. 3) and a midline 128 that bisects length 127. It is noted that rear corner tabs 87*a* and 87*b* do not extend beyond midline 128, thereby allowing inverted mating of blank 11 (and 13).

Set-up of the Box from the Blank

To set up box 12 from blank 11, the following procedure is recommended. It will be described as if one person were giving directions to another. It is noted that, because blank 11 has a minimum number of flaps that need pre-folding, the procedure is quick and easy.

With wall 45 at the top and the outer surface of the blank facing you, grasp wall 45 in the right hand and wall 41*a* in the left hand. Simultaneously fold walls 45 and 41*a* to about one-third the way to upright position. Shift the right hand to wall 41*b* and simultaneously fold walls 41*a* and 41*b* to about one-third the way to upright position. Grasp wall 43*a* (along with ancillary wall 97*a*) in the left hand and grasp wall 43*b* (along with ancillary wall panel 97*b*) in the right hand. Simultaneously fold walls 43*a* and 43*b* upright. This automatically causes walls 41*a*, 41*b*, and 45 to fold upright as well. Simultaneously fold ancillary wall panels 97*a* and 97*b* forward (or down). Then, with the outer surface of cover 50 positioned against the body, roll the bottom half of the box forward and down far enough to grasp cover 50 in both hands. Finally, pull cover flaps 110*a* and 110*b* inward (or down) and tuck them into the slots created from slot-forming slits 105*a* and 105*b*, respectively.

To re-fold or close box 12 after inserting a pizza, simultaneously push side walls 41*a* and 41*b* to an upright position. This causes walls 43*a*, 43*b*, and 45 to move upright, as well. While holding one of walls 41*a* and 41*b* upright with one hand, fold cover 50 over the box with the other hand and tuck in flaps 110*a* and 110*b*.

Box 14 is set up from blank 13 in similar manner, except that instead of inserting flaps 110*a* and 110*b* into slots 105*a* and 105*b*, first parts 111*a* and 111*b* are folded down and to the outside of walls 43*a* and 43*b*, respectively, then second parts 112*a* and 112*b* are folded inward and tucked into slots 106*a* and 106*b*, respectively, along bottom edges 63*a* and 63*b*, respectively.

Lastly, within the context of this invention, a fold line can be created by a number of means such as, for example, by a crease or score in the board, by a series of aligned spaced short slits in the board, and by a combination of aligned spaced short and long slits. In some cases, when a long slit is bounded on the ends by a series of short slits or a score, the long slit may be slightly offset in alignment from the short slits or score for the purpose of creating a slot along the fold line when the blank is set up into a box. Nonetheless, the entire combination of long and short slits is considered to constitute a single fold line unless otherwise indicated. In addition, to create a fold line where one panel is folded 180° to lay parallel on another panel, the fold line may constitute two narrowly spaced parallel scores or series of aligned slits. In this case, the two narrowly spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a type of box that embodies one or more of three unique components: (1) over-extending wall and wall-end panel configuration (2) flapless corner interlock, and (3) cover with parallel free side edges and obliquely disposed cover interlock flaps. Plus I have disclosed an optional two-part cover interlock flap that provides a positive engagement with diagonal third and fourth side walls. The box is typically used for packaging relatively flat food products such as pizza and the like; however, it can serve other purposes, as well.

Two primary advantages of my invention are minimized material usage and reduced product cost. Additional features and advantages include fast folding and re-folding, six walls for product retention and two square corners for item storage, secure cover-to-wall interlocks, reduced cover side edge curling, reduced chance of juice leakage, and opportunity for in-box pizza cutting.

The illustrated number, size, shape, type, and placement of components represent the preferred embodiment; however, many other combinations and configurations are possible within the scope of the invention.

In conclusion, it is understood that my invention is not to be limited to the disclosed embodiments but, on the contrary, is intended to cover various modifications and equivalent arrangements included within the spirit and scope of the appended claims.

I claim:

1. A one-piece blank of resilient foldable material cut and scored to define:

a bottom panel, a rear wall hingedly attached to said bottom panel at a rear wall fold line, said rear wall having a top edge, a cover hingedly attached to the top edge of said rear wall at a cover fold line, first, second, third, and fourth side walls hingedly attached to said bottom panel at first, second, third, and fourth side wall fold lines, respectively, and each having a top edge, bottom edge, front end, and rear end and having a maximum length extending from an outermost point on said front end to an outermost point on said rear end, said third and fourth side wall fold lines being disposed at an oblique angle to said first and second side wall fold lines, respectively, said first and second side wall fold lines being disposed between said rear wall fold line and said third and fourth side wall fold lines, respectively, at least one of said first and third side walls and at least one of said second and fourth side walls being of non-rectangular shape with the maximum length of the wall being longer than the bottom edge of the wall, a cover-to-third-and-fourth-wall interlock means wherein, after said blank has been folded into a box, said cover interlockingly engages with said third and fourth side walls, the above-described components being of such shape and position that, after said blank is folded into a box and said cover-to-third-and-fourth-wall interlock means is engaged, at least a portion of the rear end of said third and fourth side walls extends beyond a plane of said first and second side walls, respectively, whereby said third and fourth side walls are held in a predetermined position by being interlockingly engaged to said cover, said first and second side walls are held in a predetermined position by a resilient property of the foldable material pushing them against the third and fourth side walls, respectively, and said rear wall is held in a predetermined position by being hingedly attached to said cover.

2. The blank defined in claim 1:

wherein said resilient foldable material is corrugated paperboard;

said blank further comprising:

first and second wall-end panels hingedly attached to the front end of said first and second side walls, respectively, and to the rear end of said third and fourth side walls, respectively, whereby when one of said first and second side walls moves it causes one of said third and fourth side walls to move, respectively, said wall-end panels and said side walls being of such shape and position that, after said blank is folded into a box and said cover-to-third-and-fourth-wall interlock means is engaged, said first and second wall-end panels are disposed exterior to the plane of said first and second side walls, respectively.

3. The blank defined in claim 2, said blank further comprising:

a front wall hingedly attached to said bottom panel at a front wall fold line opposing said rear wall fold line, said front wall having first and second ends, third and fourth wall-end panels hingedly attached to the front end of said third and fourth side walls, respectively, and to the first and second ends, respectively, of said front wall, whereby when one of said third and fourth side walls moves it causes said front wall to move.

4. A one-piece blank of resilient foldable material cut and scored to define:

a bottom panel, cover, rear wall, and a plurality of other walls, two of said other walls being first and second side walls, said rear wall being hingedly attached to said bottom panel at a rear wall fold line, said rear wall having a top edge, bottom edge, first end, and second end, each said first and second end terminating in a free edge, said cover being hingedly attached to the top edge of said rear wall at a cover fold line, said cover having first and second side cover edges, said first and second side walls being hingedly attached to said bottom panel at first and second side wall fold lines, respectively, and each of the walls having front and rear ends, a cover-to-wall interlock means wherein, after said blank has been folded into a box, said cover interlockingly engages with at least one of said other walls, first and second rear corner tabs extending from the rear end of said first and second side walls, respectively, first and second openings disposed near said first and second ends, respectively, of said rear wall, each of said first and second openings being completely contained within said rear wall and having a first portion of outer periphery, each said first portion of outer periphery being disposed in approximate alignment with said first and second side wall fold lines, respectively, said first and second openings and said first and second rear corner tabs being of such shape and position that, after said blank is folded into a box and said cover-to-wall interlock means is engaged, said first and second rear corner tabs extend through said first and second openings, respectively, and contact said first portion of outer periphery of said first and second openings, respectively, and are coplanar with said first and second side walls, respectively, whereby said first and second side walls are held in a predetermined position by the resilient property of the foldable material pushing the first and second rear corner tabs against the first portion of outer periphery of said first and second openings, respectively, and said rear wall is held in a predetermined position by being hingedly attached to the cover.

5. The blank defined in claim 4 wherein:

said resilient foldable material is corrugated paperboard, said blank has a front end edge and a rear end edge and there is a lengthwise dimension extending between the front and rear end edges of said blank, and there is an imaginary midline extending across the width of said blank, said midline bisecting said lengthwise dimension, and the distance of said first and second rear corner tabs from said midline is less than ten millimeters.

6. The blank defined in claim 4 wherein:

said resilient foldable material is corrugated paperboard, said first and second openings comprise first and second opening flaps, respectively, each said opening flap being hingedly attached to an edge of the opening, wherein, after said blank is folded into a box and said first and second rear corner tabs extend through said first and second openings, each said first and second opening flap is disposed in an open position, said open position being at an angle to said rear wall.

7. A box of resilient paperboard material, said box comprising:

a bottom panel, a rear wall, first and third side walls each having a top edge, bottom edge, front end, and rear end and having a maximum length extending from an outermost point on said front end to an outermost point on said rear end, said third side wall being disposed at an oblique angle to said first side wall and said first side wall being disposed between said third side wall and said rear wall, a cover hingedly attached to said rear wall, a cover-to-wall interlock means wherein said cover is interlockingly engaged to said third side wall;

wherein:

at least one of said first and third side walls is of non-rectangular shape with the maximum length of the wall being longer than the bottom edge of the wall, at least a portion of the rear end of said third side wall extends beyond a plane of said first side wall, whereby said third side wall is held in a predetermined position by being interlockingly engaged to said cover, said first side wall is held in a predetermined position by a resilient property of the paperboard material pushing the first side wall against the third side wall, and said rear wall is held in a predetermined position by being hingedly attached to said cover.

8. The box defined in claim 7, said box further comprising:

a wall-end panel hingedly attached to the front end of said first side wall and to the rear end of said third side wall, whereby when one of said first and third side walls moves it causes the other side wall to move, said wall-end panel being disposed exterior to the plane of said first side wall.

9. A box of resilient paperboard material, said box comprising:

a bottom panel, an end wall having a first end terminating in a free edge, a side wall having a first end adjacent said end wall, a third wall, a cover hingedly attached to one of said end wall and said third wall, a cover-to-wall interlock means wherein said cover is interlockingly engaged to the other of said one of said end wall and said third wall;

wherein:

a corner tab extends coplanar from said first end of said side wall, an opening is disposed near said first end of said end wall, said opening being completely contained within said end wall and having a first portion of outer periphery, said first portion of outer periphery being disposed in approximate alignment with a plane of said side wall, wherein said corner tab extends through said opening and contacts said first portion of outer periphery of said opening, whereby said side wall is held in a predetermined position by a resilient property of the paperboard material pushing the rear corner tab against the first portion of outer periphery and said end wall is held in a predetermined position by the cover being hingedly attached to one of said end wall and said third wall and interlockingly engaged to the other of said end wall and said third wall.

10. The box defined in claim 9 wherein:

said opening comprises an opening flap hingedly attached to an edge of the opening, wherein said opening flap is disposed in an open position, said open position being at an angle to said end wall.

11. A single sheet of foldable material comprising two blanks, each of said blanks cut and scored to define:

(a) opposite front and rear end edges formed by furthermost extremities of the respective blank;

(b) a bottom panel;

(c) a rear wall hingedly attached to said bottom panel at a rear wall fold line at a bottom edge of the rear wall, said rear wall having a top edge and a free first end;

(d) s cover panel hingedly attached to the top edge of said rear wall at a rear cover edge, said cover panel including a free side edge extending from said rear cover edge along a same side of the respective blank as said free first end, said free side edge being perpendicular to the rear cover edge;

(e) a first side wall hingedly attached to said bottom panel along a fold line disposed perpendicular to the rear wall fold line, said first side wall being disposed on the same side of the respective blank as said free first end and said free side edge, said first side wall including a free top edge and a free rear end adjacent said rear wall;

wherein the blanks are oriented in nested relationship with the opposite end edges of each blank aligned with the opposite end edges of the other blank and with the first side wall of each blank disposed within a recess created by the free side edge of the cover panel, the free first end of the rear wall, and the free rear end of the first side wall of the other blank.

12. The single sheet of foldable material comprising two blanks defined in claim 11, wherein each of said blanks further comprises a diagonal side wall hingedly attached to said bottom panel along a diagonal fold line disposed at an oblique angle to said fold line disposed perpendicular to the rear wall fold line.

13. The single sheet of foldable material comprising two blanks defined in claim 11, wherein each of said blanks further comprises a front wall hingedly attached to said bottom panel along a front wall fold line disposed parallel to the rear wall fold line, said front wall having a top edge free of attachment.

14. The single sheet of foldable material comprising two blanks defined in claim 11, wherein said bottom panel of each of said blanks has a diagonal edge disposed at an oblique angle to said fold line disposed perpendicular to the rear wall fold line.

15. The single sheet of foldable material comprising two blanks defined in claim 11, wherein each of said blanks further comprises a panel hingedly attached to a front end of said first side wall.

16. The single sheet of foldable material comprising two blanks defined in claim 15, wherein each of said blanks further comprises another panel hingedly attached to said panel.

17. A one-piece blank of foldable material cut and scored to define:

(a) a bottom panel, (b) a rear wall hingedly attached to said bottom panel at a rear wall fold line, said rear wall having a top edge and first and second free ends, (c) first, second, third, and fourth side walls hingedly attached to said bottom panel at first, second, third, and fourth side wall fold lines, respectively, said first and second side wall fold lines being disposed perpendicular to said rear wall fold line and said third and fourth side wall fold lines being disposed at an oblique angle to said first and second side wall fold lines, respectively, said first and second side walls each having a front end and a free rear end, (d) a front wall hingedly attached to said bottom panel at a front wall fold line opposing said rear wall fold line, said front wall having a top edge free of attachment, (e) a cover panel having a plurality of at least five edges comprising:

(i) a rear edge hingedly attached to the top edge of said rear wall, (ii) first and second free side edges disposed perpendicular to said rear edge, (iii) a front edge free of attachment, said front edge opposing said rear edge, where in:

a recess is created by the first free side edge of the cover panel, the first free end of the rear wall, and the free rear end of the first side wall, said blank has opposite front and rear end edges formed by furthermost extremities of the blank and a predetermined length extending between said furthermost extremities, said blank has an imaginary midline bisecting said predetermined length, both the front end and the free rear end of each of the first and second side walls are disposed on a same side of said imaginary midline, whereby said blank can be oriented in nested relationship with another blank of same structure as said blank and the opposite end edges of the blanks will align and a portion of the first side wall of one of the blanks will fit within the recess of the other blank.

* * * * *

UNITED STATES PATENT AND TRADEMARK OFFICE

CERTIFICATE OF CORRECTION

PATENT NO. : 5,553,771
DATED : September 10, 1996
INVENTOR(S) : John D. Correll

It is certified that error appears in the above-indentified patent and that said Letters Patent is hereby corrected as shown below:

Title page, item [56] under References Cited, add the followings:

| DOCUMENT NUMBER | DATE | NAME | CLASS | SUBCLASS | FILING DATE IF APPROPRIATE |
|---|---|---|---|---|---|
| 4765534 | 1988 | ZION ET AL | 229 | 109 | |
| 5110039 | 1992 | PHILIPS | 229 | 110 | |
| 5118032 | 1992 | GEHO | 229 | 110 | |
| 5211329 | 1993 | PATTON | 229 | 110 | |
| 5263634 | 1993 | KORINE | 229 | 109 | |
| 1482727 | 1924 | BORCHERS | — | — | |
| 1959613 | 1934 | CARSON | — | — | |
| 2071949 | 1937 | REICH | — | — | |
| 2336494 | 1943 | METCALF | — | — | |
| 3964668 | 1976 | LIN | 229 | 35 | |
| 4279933 | 1981 | AUSTIN ET AL. | 426 | 124 | |

UNITED STATES PATENT AND TRADEMARK OFFICE

CERTIFICATE OF CORRECTION

PATENT NO. : 5,553,771

DATED : September 10, 1996

INVENTOR(S) : John D. Correll

It is certified that error appears in the above-indentified patent and that said Letters Patent is hereby corrected as shown below:

| DOCUMENT NUMBER | DATE | NAME | CLASS | SUBCLASS | FILING DATE IF APPROPRIAT |
|---|---|---|---|---|---|
| 4362266 | 1982 | WERLINGER | 229 | 33 | |
| 2072753 | 1937 | IKEDA ET AL | — | — | |
| 2147676 | 1939 | SHOEMAKER | — | — | |
| 4265393 | 1981 | ORCHARD | 229 | 40 | |

Signed and Sealed this

Tenth Day of December, 1996

Bruce Lehman

*Attest:*

BRUCE LEHMAN

*Attesting Officer*

*Commissioner of Patents and Trademarks*